United States Patent [19]

Holleyman

[11] Patent Number: 4,507,918

[45] Date of Patent: Apr. 2, 1985

[54] RECIPROCATING PISTON COMPRESSED FLUID ENGINE HAVING RADIAL CYLINDERS AND TRIGGERABLE VALVES

[76] Inventor: John E. Holleyman, 3402 Polk St., Monroe, La. 71201

[21] Appl. No.: 541,533

[22] Filed: Oct. 13, 1983

[51] Int. Cl.[3] ..... F16D 31/02; F01B 13/06

[52] U.S. Cl. ..... 60/370; 91/310; 91/476; 91/491; 91/495; 60/371; 60/407

[58] Field of Search ..... 91/180, 305, 310, 472, 91/476, 491, 493–495; 417/273; 60/370, 371, 407, 412

[56] References Cited

U.S. PATENT DOCUMENTS

| | | | |
|---|---|---|---|
| 1,220,173 | 3/1917 | Borras et al. | 91/491 X |
| 2,246,074 | 6/1941 | Joy | 91/493 X |
| 2,260,458 | 10/1941 | Jones | 91/180 |
| 3,563,032 | 2/1971 | La Pointe | 60/412 X |
| 3,661,059 | 5/1972 | Hunter et al. | 91/499 |
| 3,925,984 | 12/1975 | Holleyman | 60/370 |
| 4,004,498 | 1/1977 | Aoki | 91/476 |
| 4,018,050 | 4/1977 | Murphy | 60/370 |
| 4,043,126 | 8/1977 | Santos | 60/412 X |
| 4,066,002 | 1/1978 | Eastman | 91/492 X |
| 4,162,614 | 7/1979 | Holleyman | 60/370 |
| 4,208,592 | 6/1980 | Leibow et al. | 60/407 X |
| 4,381,179 | 4/1983 | Pareja | 417/273 |
| 4,404,800 | 9/1983 | Penney | 60/412 X |

FOREIGN PATENT DOCUMENTS

| | | | |
|---|---|---|---|
| 784539 | 4/1935 | France | 91/495 |

*Primary Examiner*—William L. Freeh
*Assistant Examiner*—Paul F. Neils

[57] ABSTRACT

A compressed fluid reciprocating piston engine provides for cylinders radially disposed about a crankshaft and coupled thereto by means of piston rods engaging a disc rotatable with the crankshaft. Exhaust fluid feedback is merged into higher pressure fuel at a venturi throat section in the fuel conveyance line where the pressures are temporarily substantially equalized. A timer distributor mechanism consists of a disc rotatable by a shaft as journalled between two outer panels thereby with a rotating aperture hole to provide pressurized fluid through a scanned sequence of outlet lines serving to operate fluid input valves coupling a fluid pressure source selectively to power the reciprocating pistons.

2 Claims, 12 Drawing Figures

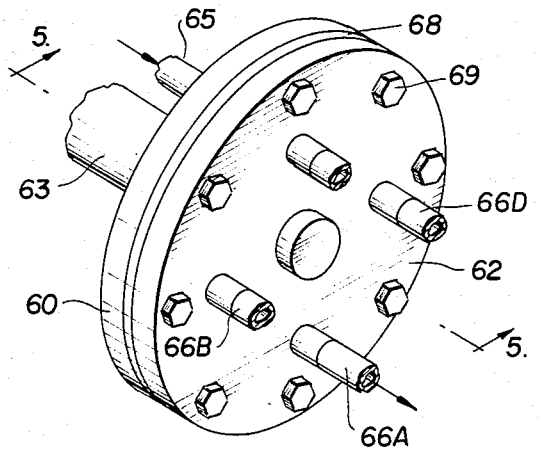
FIG. 4
FIG. 5
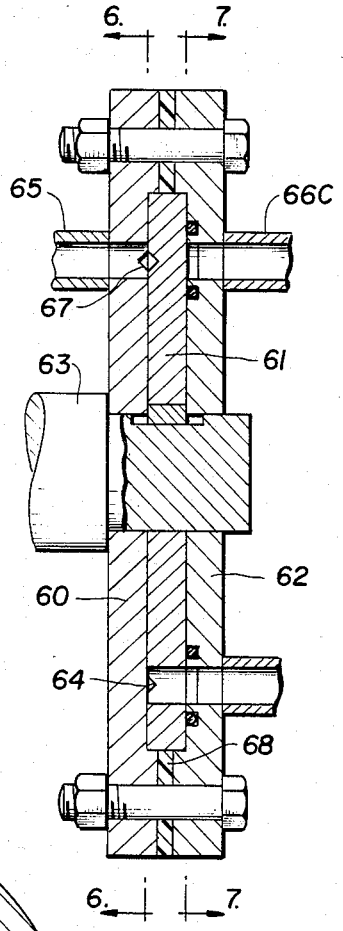
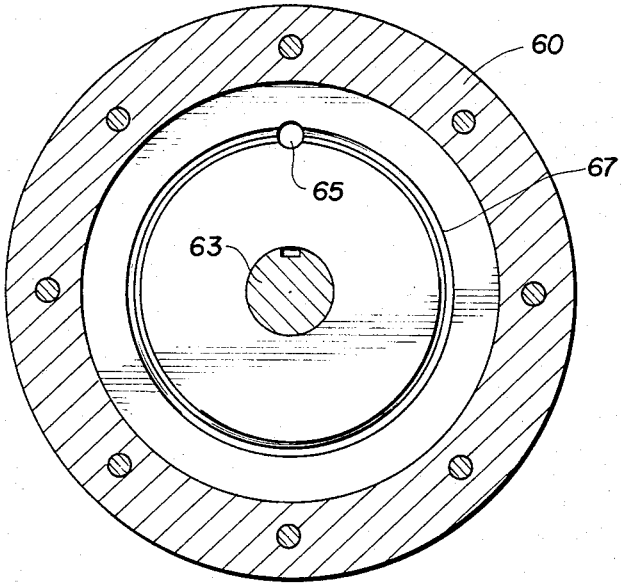
FIG. 6
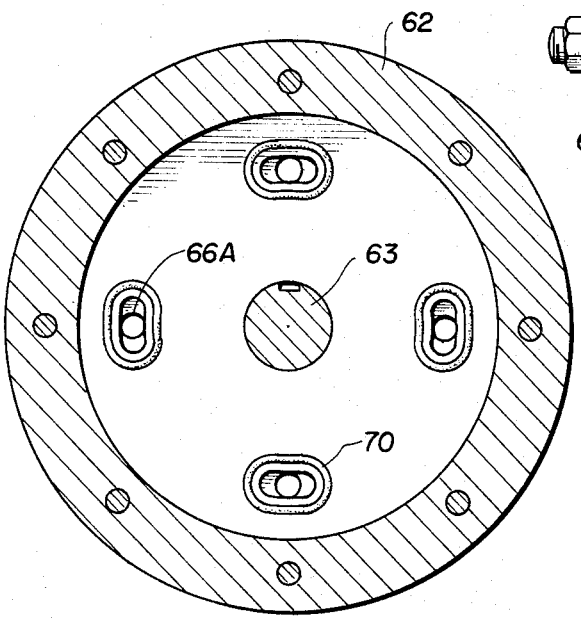
FIG. 7

FIG. 11
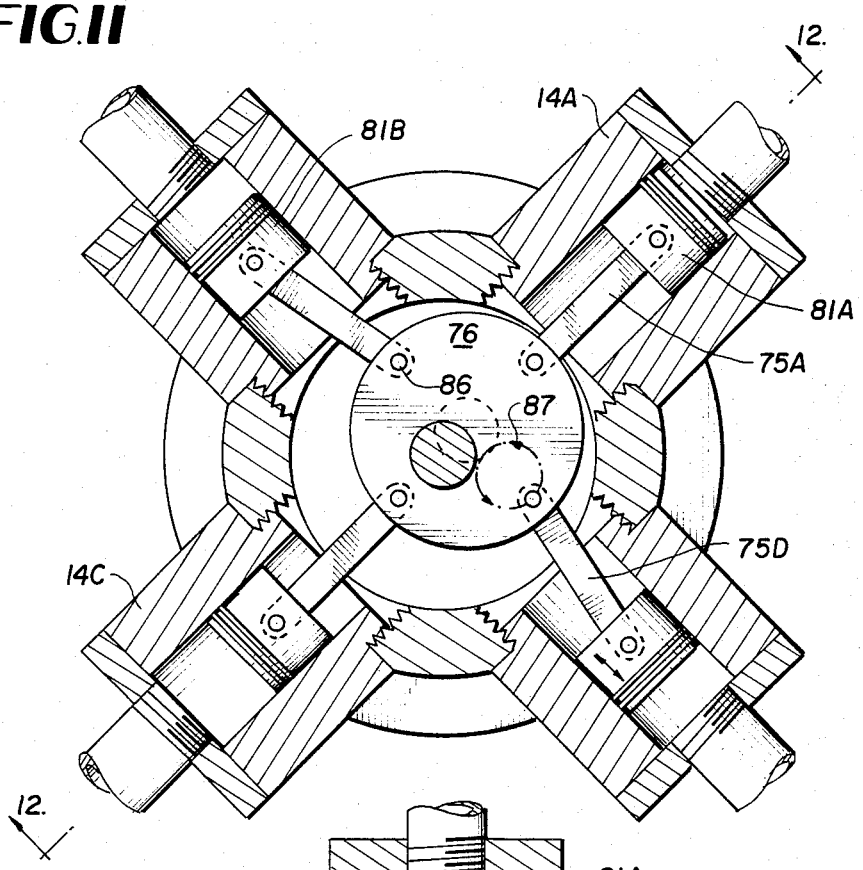
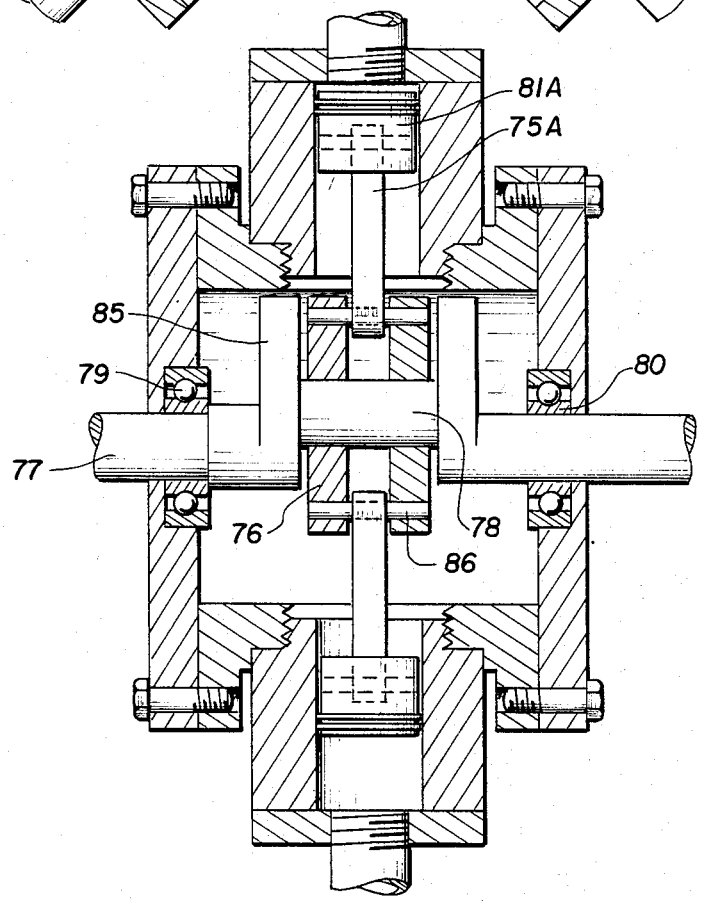
FIG. 12

RECIPROCATING PISTON COMPRESSED FLUID ENGINE HAVING RADIAL CYLINDERS AND TRIGGERABLE VALVES

TECHNICAL FIELD

This invention relates to pressure actuated engines operable from compressed fluids such as air and natural gas, and more particularly it relates to compact light weight such engines having a plurality of cylinders radially disposed about a crankshaft. BACKGROUND ART Prior compressed fluid engines are found in my earlier U.S. Pat. Nos. 3,925,984 of Dec. 16, 1975 and 4,162,614 of July 31, 1979. These patents, representative of the prior art, relate to in line parallel piston arrangement with mechanical cam type distribution timers.

These engines can use as a motive source compressed fluids such as air and natural gas.

Some disadvantages of this prior art are heavy weight, bulky size, many parts, high friction and low reliability because of wear of critical parts such as mechanically cammed distribution timers.

This invention therefore has as its objective to overcome these problems.

DISCLOSURE OF THE INVENTION

In accordance with this invention weight, friction and the number of parts are decreased significantly by means of pistons radially mounted about the crankshaft and connected by piston rods to rotatable plate assembly operating the crankshaft. Thus, shorter strokes, fewer bearings and novel structural features are provided to afford longer wear and more efficient operation.

In particular is provided a camless rotary distributor timer assembly synchronously driven by the crankshaft through a timing belt operates a set of triggerable valves resident in a piston cylinder exhaust position into an input power stroke position to admit the pressurized fluid to each piston cylinder. This constitutes a single moving part consisting of a rotatable distribution plate driven by an extended shaft and sandwiched between two cover plates respectively for admitting fluid under pressure and selectively distributing it to trigger the valves for the respective pistons.

BRIEF DESCRIPTION OF THE DRAWINGS

Further objects, features and advantages of the invention will be found throughout the following description and claims, and in the drawings, wherein:

FIG. 4 is an assembly drawing of a distributor timer provided by this invention;

FIG. 5 is a section view of the distributor timer taken along lines 5—5 of FIG. 4;

FIGS. 6 and 7 are respective section views taken along lines 6—6 and 7—7 of FIG. 5;

FIG. 11 is a section view showing the piston radially disposed about the crankshaft; and FIG. 12 is a section view taken along lines 12—12 of FIG. 11 showing the piston to crankshaft connection mechanism afforded by this invention.

THE PREFERRED EMBODIMENT

Figure 1:
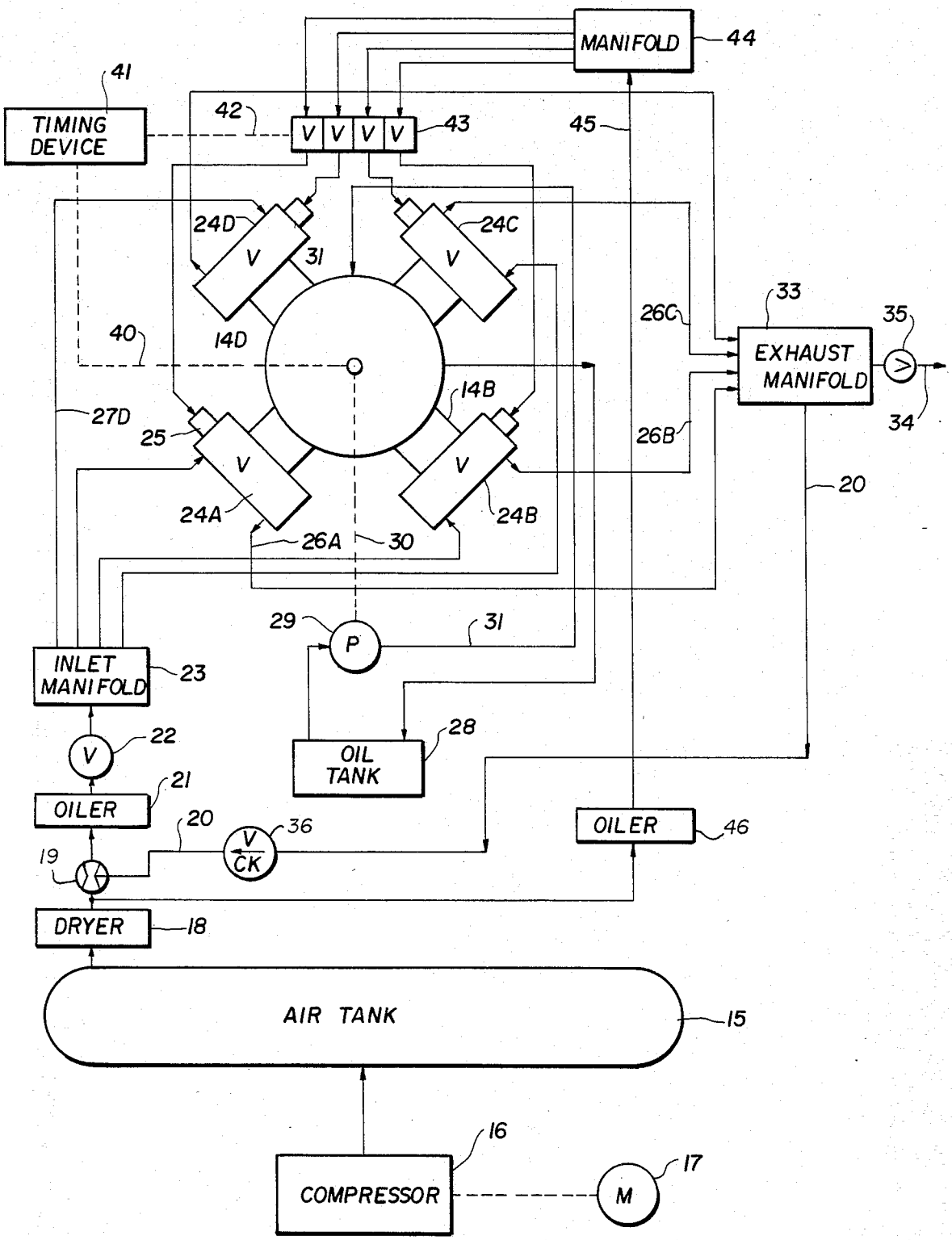
FIG. 1 is a schematic block diagram of the compressed fluid engine system embodying the invention.
Figure 2:
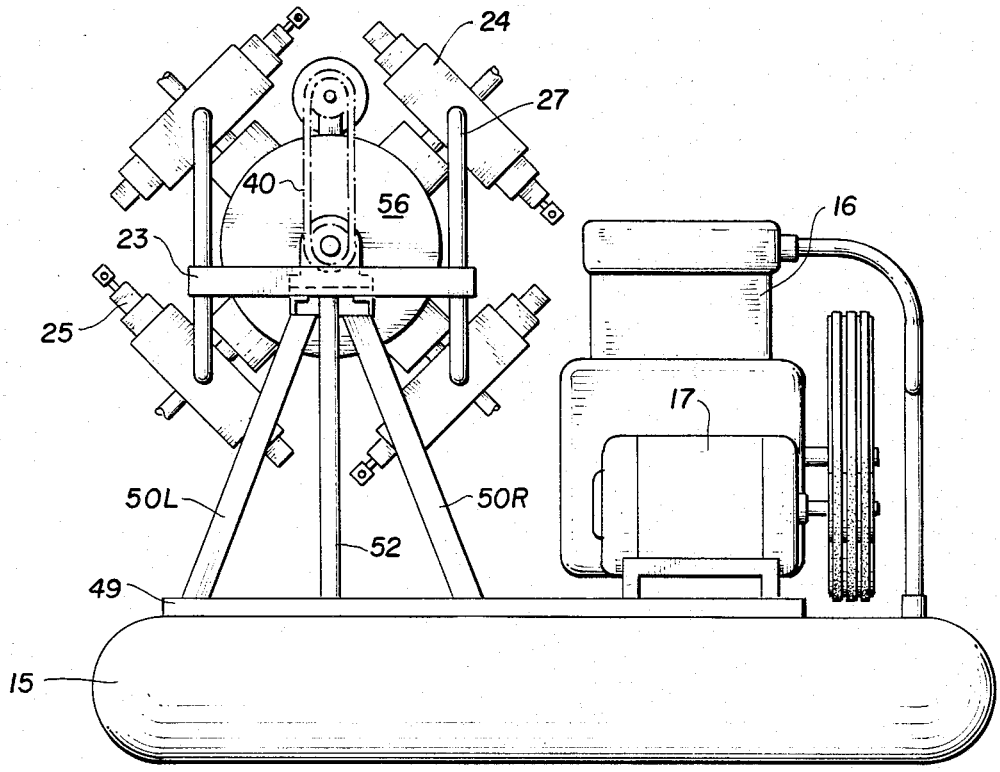
FIGS. 2 and 3 are respectively elevation and end views of an engine provided by the invention.
Figure 3:
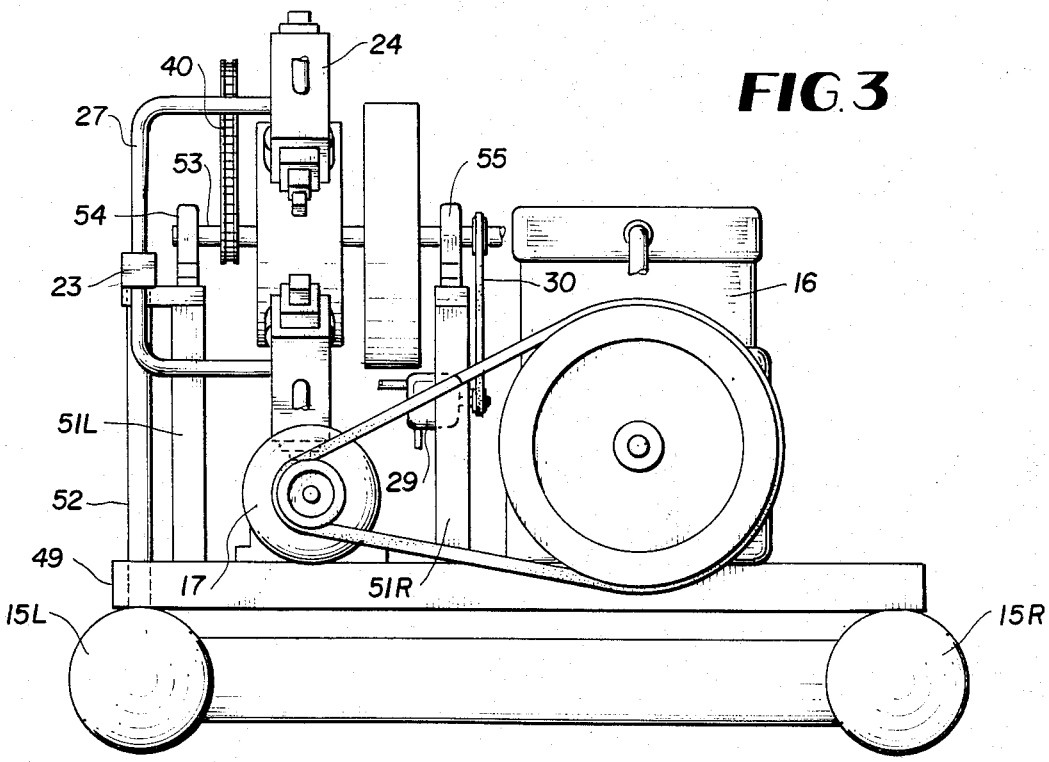
Figure 8:
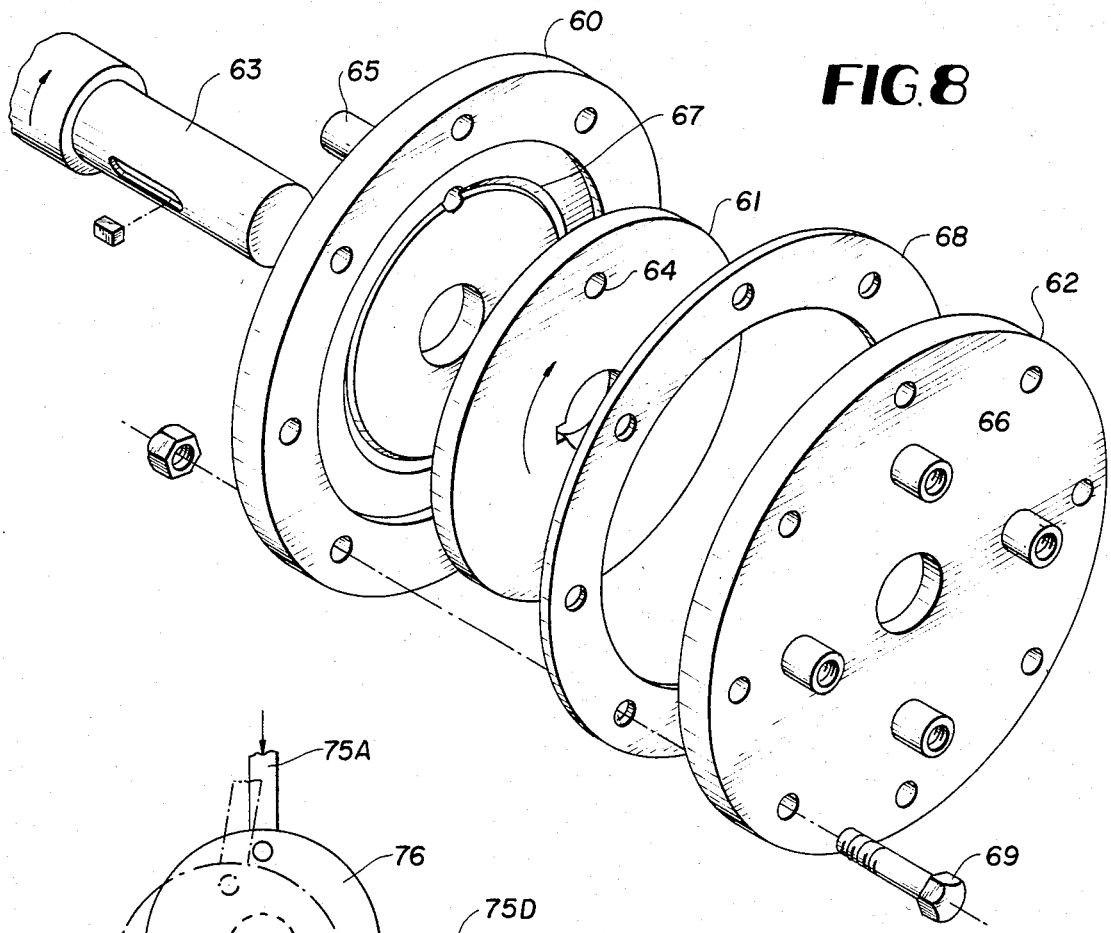
FIG. 8 is an exploded assembly view of the distributor timer of FIG. 4.

For an overview understanding of the assembled engine and its encompassed system organization as afforded by this invention, reference is made to the diagrammatic view of FIG. 1 along with the engine assembly views of FIGS. 2 and 3. Throughout similar reference characters are used to indicate equivalent parts, thereby to facilitate comparison between the views.

The engine afforded by this invention is driven by compressed fluid such as air or natural gas which is supplied in an air tank 15. For emergency operation when air is low, for recharging the tank away from a source such as a natural gas well providing gas under pressure, or for other purposes a compressor 16 is driven by an electric or gas motor 17. The fluid such as air, is dried at dryer 18, passed through venturi mixer 19 (later described) which recirculates some of the spent fluid by means of conduit 20. Note that if a combustible fluid such as natural gas is used, the system cannot generate sparks, or enough heat to ignite the fluid. This system thus works solely with fluids and without any electrical connections, etc., and is a low temperature engine, particularly in view of the few parts and low friction of this embodiment. To lubricate the pistons and upper piston cylinders 14, the fluid is appropriately oiled at oiler 21. Also the interior of the engine and bearings and lower piston cylinders are lubricated from oil tank 28 via engine driven-pump 29 designated by dotted line 30 and oil line 31. Oil is returned to tank 28 by return line 32.

The throttle valve 22 controls the amount of fluid passing to inlet manifold 23 which by way of valves 24A to 24D is distributed and timed into the respective cylinders, which in this embodiment are four, but which may be two or more as a general embodiment. The valves 24 are triggered valves with trigger fluid pressure chambers 25, as more completely described in my aforesaid U.S. Pat. No. 4,162,614. Thus, the trigger valve is resident in an exhaust position permitting cylinders 14 to exhaust through exhaust lines 26A to 26D, and when triggered will change to inlet position for receiving fluid at inlet lines 27A to 27D.

The exhaust lines 26A to 26D lead to exhaust manifold 33 and exhaust pipe 34. The fluid here has lower energy than input fluid at inlet lines 27 because of work done in operating the engine, but still has far greater than atmospheric pressure. Thus by means of a restriction valve 35, some of the fluid can pass through recirculation line 20 and check valve 36 to the venturi mixer valve 19 where the pressures of the compressed fluid and recirculated fluid are temporarily equalized for mixing and recirculating purposes. Therefore this produces greater motive fluid efficiency, particularly as the engine speed increases and the exhaust fluid at restriction valve 35 builds up a counterpressure, thereby producing a turbo effect.

Also coupled for synchronous drive with the engine by means of a timing belt 40 is a distributor timer 41 which cyclically opens (42) gate valves 43 supplied with fluid under pressure from manifold 44 and line 45 from air tank 15. The valves 43 are oiled by oiler 46 in the fluid supply line 45.

The assembly can have as a mounting base a pair of interconnected air tanks 15L and 15R, upon which platform 49 is placed to mount the compressor 16. The engine is braced thereon at 50, 51. Fluid supply line 52 derives air from both tanks. The camshaft and main power shaft 53 is journalled in bearings 54, 55. A flywheel 56 is mounted on shaft 53.

The camless rotary fluid operated distributor timing mechanism is better understood by reference to FIGS. 4 through 8. Thus a sandwich of three plates 60, 61, 62 with the innermost plate 61 journalled for interior rotation by means of extended shaft 63 serves by scanning with aperture 64 to distribute fluid from inlet 65 to respective valve outlet conduits 66A to 66D. The internal ring groove 67 in outer plate 60 communicates fluid to aperture 64 while internal disc 61 is rotating. Gasket 68 seals the fluid in by means of bolts 69, and lubrication is effected as aforesaid. Note that the flow of fluid can be controlled over a desired arc of rotation by shaping the outer disc 62 with channels 70 surrounding the outlet apertures 66.

Figure 9:
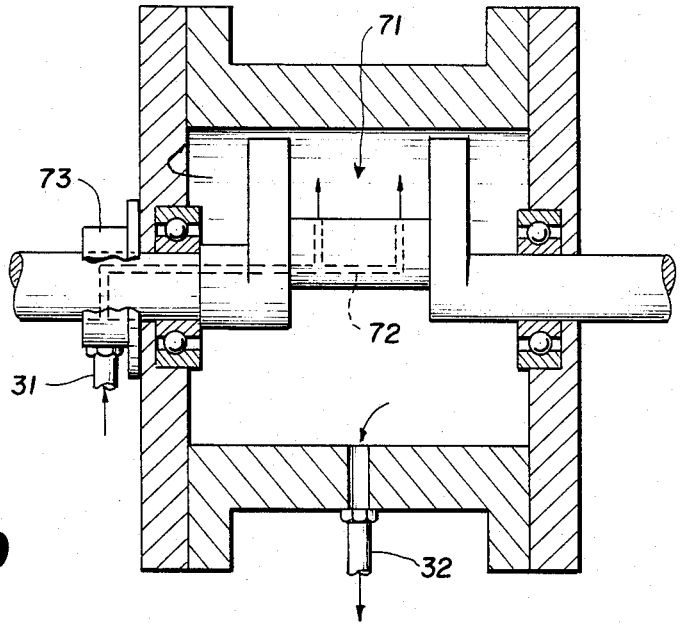
FIG. 9 is a section view of the crankshaft mount and oiling system.

In FIG. 9 the oil inlet 31 and outlet 32 from the engine interior cavity 71 is shown together with the oil distribution grooves 72 and rotary distribution collar 73.

Figure 10:
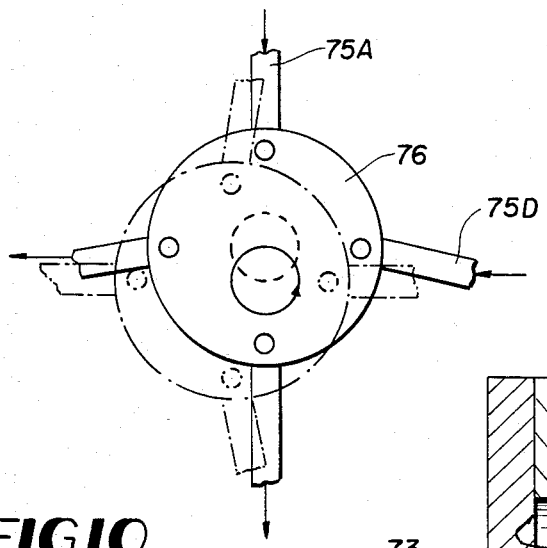
FIG. 10 is a diagrammatic view illustrating movement of the rotary plate and crankshaft by the piston rods.

FIGS. 10 to 12 show the manner that piston rods 75A to 75D convert short strokes of pistons 81A to 81D when sequentially powered by inlet fluid under pressure to eccentric travel of discs 76 and accordingly rotate therewith the crankshaft 77 onto which the discs are journalled at bearing 78. Note that the crankshaft 77 is short, takes up little room and requires only two main bearings 79 and 80. Counterbalances 85 are supplied. The piston rods 75A to 75D are connected to the pair of spaced discs 76 by wrist pins 86. Motion of the wrist pin and thus the disc 76 during the piston 81 reciprocation cycle is illustrated by the dotted line pathway 87.

Those novel features of the invention believed descriptive of the nature and spirit of the invention are defined with particularity in the following claims.

I claim:

1. A multiple piston and cylinder type engine driven by a compressed fluid, comprising in combination, a crankshaft, a rotatable plate assembly mounted to rotate the crankshaft, a set of reciprocatable pistons moving in cylinders arranged generally radially about the crankshaft and connected to the rotatable plate by piston rods for rotating it and thereby the crankshaft, a fluid source for supplying fluid under pressure, a set of triggerable valves connected for control of fluid to and from said cylinders, resident in an exhaust position and movable to an intake position admitting said fluid under pressure from said source by a fluid pressure triggering force, rotary distributor means synchronously driven by the crankshaft for coupling fluid pressure from said source to trigger said valves into the intake position in a sequence and timing to convert the fluid source pressure into crankshaft rotation power, a venturi connector in a motive fluid supply line leading to the cylinders thereby to produce temporarily a lower energy mixing region for merging exhaust fluid into the motive fluid flow path at a transit point of substantially equalized pressure and returning the pressure to substantially that of the source fluid for driving said pistons, and a feedback conduit coupled through a check valve to recirculate a part of the exhaust fluids passing through the valves at the pressure of the mixing region into the fluid flow path to supplement the fluid from said source.

2. A multiple piston and cylinder type engine driven by a compressed fluid, comprising in combination, a crankshaft, a rotatable plate assembly mounted to rotate the crankshaft, a set of reciprocatable pistons moving in cylinders arranged generally radially about the crankshaft and connected to the rotatable plate by piston rods for rotating it and thereby the crankshaft, a fluid source for supplying fluid under pressure, a set of triggerable valves connected for control of fluid to and from said cylinders, resident in an exhaust position and movable to an intake position admitting said fluid under pressure from said source by a fluid pressure triggering force, and rotary distributor means synchronously driven by the crankshaft for coupling fluid pressure from said source to trigger said valves into the intake position in a sequence and timing to convert the fluid source pressure into crankshaft rotation power, wherein the rotary distributor means is a camless arrangement consisting of a sandwich of three plates, the innermost plate being rotatable by a shaft extending therefrom and journalled to rotate between the outermost two plates, one end plate being connected to supply fluid from said source about a ring communicating with a rotating aperture in said rotatable plate and the other end plate being connected by a set of apertures scanned by the aperture in the rotating plate to supply fluid in succession to trigger selected ones of the valves.

* * * * *